US005970571A

United States Patent [19]

Ochss

[11] Patent Number: 5,970,571

[45] Date of Patent: Oct. 26, 1999

[54] SUCTION HOOD FOR WET FLOOR CLEANING MACHINES

[75] Inventor: Dieter Ochss, Albershausen, Germany

[73] Assignee: Nilfisk Schwamborn GmbH, Wangen, Germany

[21] Appl. No.: 08/849,590

[22] PCT Filed: Apr. 11, 1996

[86] PCT No.: PCT/EP96/01546

§ 371 Date: Aug. 18, 1997

§ 102(e) Date: Aug. 18, 1997

[51] Int. Cl.[6] ..... A47L 11/30

[52] U.S. Cl. ..... 15/320; 15/359; 15/401

[58] Field of Search ..... 15/359, 320, 401

[56] References Cited

U.S. PATENT DOCUMENTS

| | | | |
|---|---|---|---|
| 3,942,214 | 3/1976 | Masberg | 15/340.1 X |
| 4,620,341 | 11/1986 | Rigby | 15/339 |
| 4,953,254 | 9/1990 | Kohl et al. | 15/320 |
| 5,319,828 | 6/1994 | Waldhauser et al. | 15/320 |
| 5,465,456 | 11/1995 | Felhauer et al. | 15/339 X |

FOREIGN PATENT DOCUMENTS

| | | |
|---|---|---|
| 195 10 340 C1 | 4/1996 | Germany . |
| 486499 | 6/1938 | United Kingdom . |

*Primary Examiner*—Chris K. Moore
*Attorney, Agent, or Firm*—Friedrich Kueffner

[57] ABSTRACT

In a suction hood (2) for a wet floor cleaning machine (1) in which a motor-driven scrubbing roller (3) rotates, accompanied by application of water, on an axle (free-arm axle) which is clamped in on only one side within the suction hood (2) which overlaps this axle (7) at both ends, this suction hood (2) is guided so as to be displaceable axially relative to the scrubbing roller (3).

5 Claims, 1 Drawing Sheet

SUCTION HOOD FOR WET FLOOR CLEANING MACHINES

BACKGROUND OF THE INVENTION

1. Field of the Invention

The invention is directed to a suction hood for wet floor cleaning machines primarily for commercial use.

2. Description of the Related Art

A device of the above-described type is disclosed in U.S. Pat. No. 4,817,233.

The set of problems in all machines of this generic type known heretofore which arise with respect to the dry suction of the floor surfaces to be cleaned consists above all in that, in order to achieve the desired suction effect, the suction hood must project to some extent beyond the ends of the scrubbing roller, which, in turn, however, brings about the disadvantage that an overlap of suitable extent inevitably prevents the scrubbing roller from moving close enough to corners and edges, so that strips of dirt are left behind.

SUMMARY OF THE INVENTION

Therefore, the object of the present invention is to provide a type of construction or an arrangement with respect to the suction hood which also makes it possible for the scrubbing roller to move all the way up to the edges of rooms and accordingly makes it possible to completely clean such floor surfaces.

This object is met in a convincingly simple manner by means of the combined interaction of the two following constructional features:

a) the scrubbing roller is mounted on a free-arm axle, as it is called, which is clamped in at only one end; and b) the suction hood is mounted and guided at the machine frame so as to be displaceable axially relative to the scrubbing roller.

Thus, while the brush roller moves out along edges, the suction hood can accordingly retreat or draw back at a maximum until the plane vertical to the free end face of the scrubbing roller and can accordingly enable a precise cleaning of the respective floor surface with regard to edges while retaining the full suction action. Special constructional design features of this invention are explained more fully with reference to schematic drawings.

DESCRIPTION OF THE PREFERRED EMBODIMENTS

Figure 1:
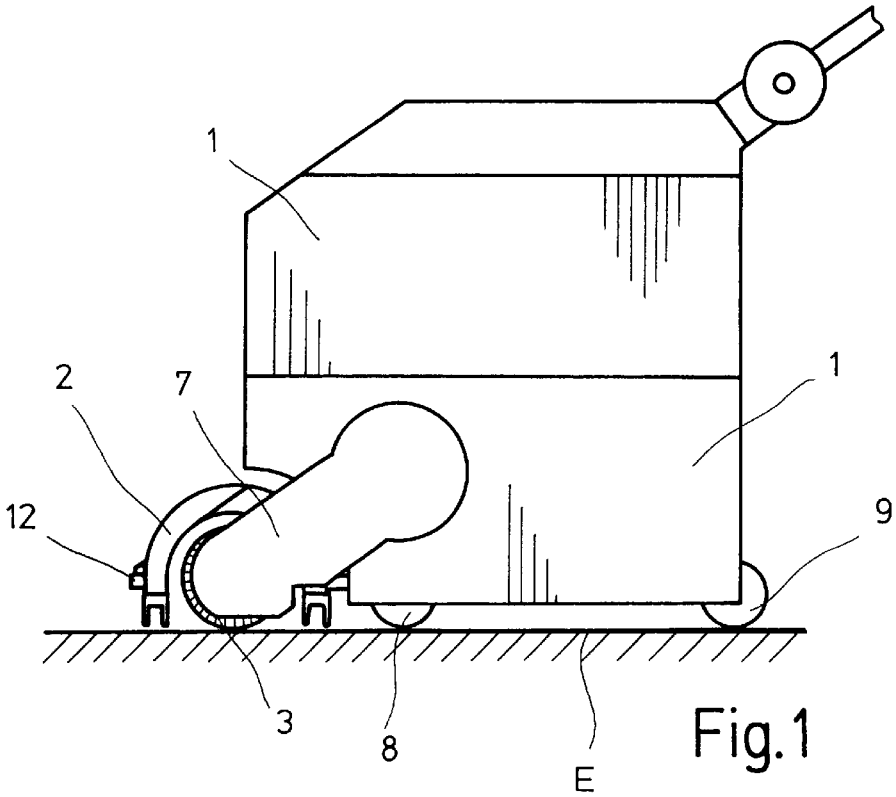
FIG. 1 shows a schematic illustration of a floor cleaning machine as viewed from the side.

The floor cleaning machine 1 which is indicated in a purely schematic manner in outline in FIG. 1 has, in its front region, a scrubbing roller 3 with a suction hood 2 overlapping the latter; thus, the entire cleaning process of floor surface E, including supply of water, scrubbing, and dry suction, is carried out in a manner known per se in the front region of the machine. The novel combination in accordance with FIG. 2 consists in that the motor-driven scrubbing roller 3 rotates on an axle 7 (free-arm axle) which is clamped in on only one side within the suction hood 2 which overlaps this axle 7 at both ends, this suction hood 2 being guided so as to be displaceable axially relative to the scrubbing roller 3 in the direction indicated by double arrow P.

Figure 2:
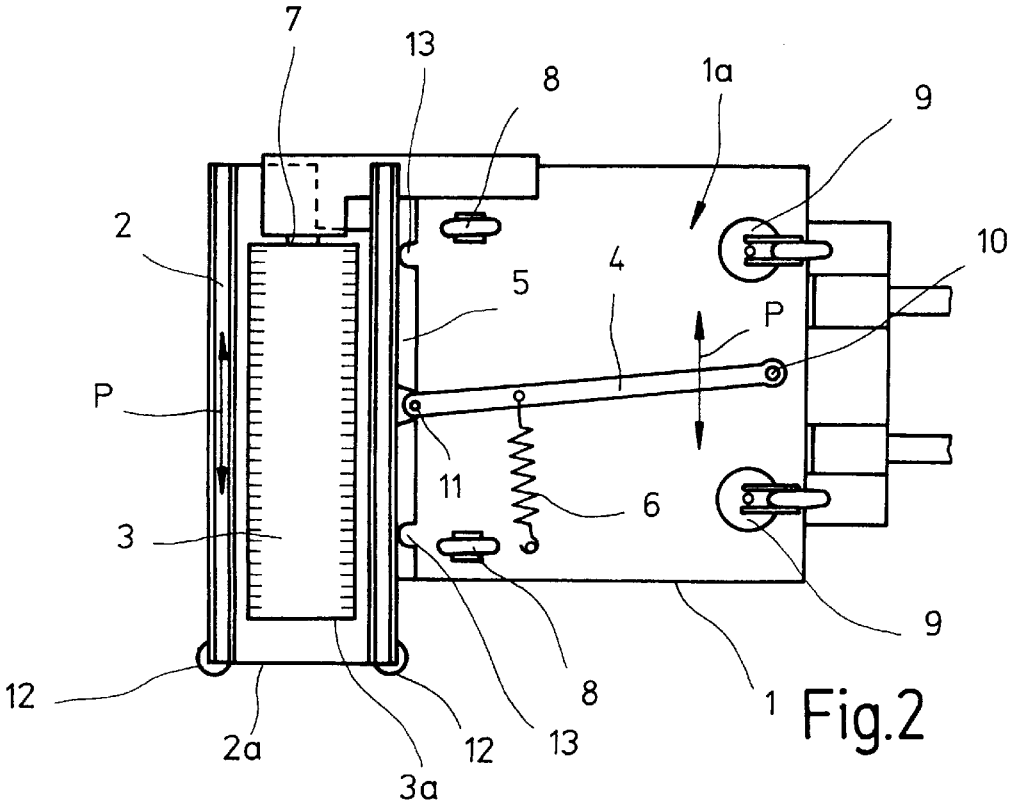
FIG. 2 shows a bottom view of the machine.

In a special constructional development, it is provided in the illustrated embodiment example that a (parallelogram) bar linkage 4, 5 with restoring spring or return spring 6 serves as a guide element for the axial displacement of the suction hood 2, wherein the linkage bars 4, 5 and return spring 6 are arranged at the underside 1*a* of the machine so as to be exposed or protected within the housing. The linkage bar 4 is connected to the bottom of the cleaning machine 1 in pivot 10. The other end of the linkage bar 4 is connected to the linkage bar 5 in articulation point 11. The linkage bar 5, in turn, as shown in FIG. 2, is connected to the hood 2. The movement of the hood 2 in axial direction is limited by limit stops 13. In the parallelogram bar linkage referred to above, two linkage bars 4 extending parallel to each other are connected to the bottom of the machine 1 and the linkage bar 5. Guide rollers 12 are provided at the end of the suction hood 2. Further, any other type of linear guide for the suction hood 2 can be used instead of the solution which is shown in the drawing only by way of example, and any other known type of aligning elements can be used instead of the return spring 6. Running rollers 8 and steering rollers 9 are mounted at the bottom of the cleaning machine 1.

I claim:

1. A suction hood in combination with a wet floor cleaning machine, comprising a free-arm axle clamped at only one end thereof to the wet floor cleaning machine, and a motor-driven scrubbing roller mounted so as to rotate on the free-arm axle within the suction hood, wherein the suction hood overlaps the axle at both ends thereof, further comprising means for applying water to the scrubbing roller, and guide means for axially guiding the suction hood relative to the scrubbing roller.

2. The suction hood according to claim 1, wherein the guide means is comprised of a bar linkage comprising a first linkage bar connected to the suction hood and a second linkage bar connected pivotally at one end thereof to the first linkage bar and at another end thereof to the wet floor cleaning machine, further comprising a return spring attached to the wet floor cleaning machine and the second linkage bar.

3. The suction hood according to claim 2, wherein the bar linkage is a parallelogram bar linkage.

4. The suction hood according to claim 2, wherein the linkage bars and the return spring are mounted at an underside of the wet floor cleaning machine.

5. The suction hood according to claim 1, wherein the wet floor cleaning machine has a housing, and wherein the guide means for axially displacing the suction hood are mounted at least partially within an interior of the housing.

* * * * *